United States Patent [19]

Abbott et al.

[11] 4,161,923

[45] Jul. 24, 1979

[54] ELECTROPHOTOGRAPHIC DEVELOPER WITH CARRIER OVERFLOW CONTROL

[75] Inventors: Jerry J. Abbott; William J. Bernardelli, both of Longmont; John A. Thompson, Boulder; Allison H. Caudill, Lafayette, all of Colo.

[73] Assignee: International Business Machines Corporation, Armonk, N.Y.

[21] Appl. No.: 863,496

[22] Filed: Dec. 22, 1977

[51] Int. Cl.[2] ..... G03G 13/09

[52] U.S. Cl. ..... 118/658; 427/18

[58] Field of Search ..... 118/653, 657, 658, 661, 118/656; 427/18

[56] References Cited

U.S. PATENT DOCUMENTS

| | | | |
|---|---|---|---|
| 3,572,922 | 3/1971 | Olden | 118/657 X |
| 3,608,522 | 9/1971 | Davidson | 118/658 |
| 3,754,526 | 8/1973 | Caudill | 118/658 |
| 3,828,730 | 8/1974 | Yamashita et al. | 118/658 |
| 3,863,603 | 2/1975 | Buckley et al. | 118/658 |
| 3,882,821 | 5/1975 | Katayama et al. | 118/657 |
| 3,909,864 | 10/1975 | Tanaka et al. | 118/655 |
| 3,999,514 | 12/1976 | Abbott et al. | 118/657 |
| 4,007,707 | 2/1977 | Buchan et al. | 118/647 |
| 4,026,241 | 5/1977 | Takebe et al. | 118/658 X |

OTHER PUBLICATIONS

IBM Technical Disclosure Bulletin, vol. 17, No. 3, Aug. 1974, "Magnetic Conveyor Roll", pp. 675–676, R. A. Daniels et al.

*Primary Examiner*—Mervin Stein

*Attorney, Agent, or Firm*—Charles E. Rohrer

[57] ABSTRACT

A magnetic-brush developer for use in an electrophotographic machine wherein the magnetic brush is used to transport toner-coated carrier particles to an elevated development zone from a pickup zone. A path for so moving the carrier is provided between the magnetic brush roll and an overflow plate, the lower end of which also serves as a doctoring blade. The carrier is moved to the top of the roll where a doctoring blade limits the amount of carrier entering the development zone. Excess carrier is accumulated in an expanded spatial area near the doctoring blade and returned to the vicinity of the pickup zone by falling back between the overflow plate and the housing. An area is provided near the doctoring blade at the top of the roll where no magnetic field is present. The overflow plate is made of non-magnetic material.

8 Claims, 3 Drawing Figures

ELECTROPHOTOGRAPHIC DEVELOPER WITH CARRIER OVERFLOW CONTROL

This invention relates to electrophotographic machines and more particularly to a magnetic-brush developer with a return path for excess carrier.

BACKGROUND OF THE INVENTION

In electrophotographic machines a photoconductive material is charged in a uniform manner and then exposed to light reflected from an original to be copied. That light variably discharges the photoconductive material thus providing an image of the original on the photoconductive surface. The image is then developed through the application of toner which typically is a black powdery substance electrically attracted to the undischarged areas of the image. After development the image is transferred to a piece of copy paper and fused thereto.

Magnetic-brush developers provide high quality development of latent images. These developers generally comprise a rotating hollow shell made of non-magnetic material with numerous stationary magnets disposed within. A developing mix is typically comprised of small steel beads, called carrier, which are magnetically attracted to the surface of the rotating roll by virtue of the magnets disposed therein and the above-mentioned toner. The small steel beads are coated with the black powdery toner and carry the toner along the surface of the magnetic-brush roll into the development zone where the toner may be electrically attracted from the steel beads to the latent image. A typical magnetic brush developer is shown in U.S. Pat. No. 3,999,514; which patent is incorporated herein by reference. This invention represents an improvement to the mechanism shown in the above-mentioned patent in which the magnetic-brush roll is used to transport the developer mix out of the sump area as well as to deliver the developer mix to the latent image at the development zone.

In magnetic-brush developers it is important to achieve steady and uniform carrier bead flow from a pickup area to the development zone. In that manner, an ample supply of toner will be provided to develop the latent image. However, erratic and unstable carrier bead flow can occur if carrier beads pack or jam while being carried toward the development zone. Such a condition was found to occur at times in the developer of the above-mentioned patent near the top doctoring blade just prior to entering the development zone.

The inventors herein have discovered that this condition can be avoided by providing a non-magnetic overflow plate to separate the transport area of the developer into two separate paths. In the first path, next to the rotating magnetic-brush shell, carrier beads are transported in the customary manner from a pickup zone toward the development zone. However, a second path is provided between the overflow plate and the inner surface of the developer housing so that if any excess magnetic carrier beads are present near the top doctoring blade, they may be returned to the pickup zone through that second path. The inventors also discovered that the magnetic fields supplied to transport carrier beads toward the development zone should be separated from the magnetic field at the development zone so that excess carrier beads can be moved away from the surface of the rotating magnetic-brush roll and out to the overflow plate without the binding effect of magnetic attraction during that movement.

As a result of this improvement the bead flow against the photoconductor has been maintained steady and uniform since jamming of excess quantities of carrier beads near the developmemt zone has been eliminated. Additionally, since a packed condition of carrier beads greatly increased the wear rate of carrier coating and caused a milling of toner particles, these undesirable effects were also eliminated. Other advantages of the invention include the fact that power requirements to drive the developer were decreased; the temperature rise of the developer mix was minimized; and certain critical adjustments and parts, such as doctor blade clearance, roll to photoconductor clearance, magnet strength and mix weight in the developer were made less critical.

SUMMARY OF THE INVENTION

This invention provides an overflow plate means in a magnetic-brush developer whereby carrier beads are transported from a pickup zone along a first path between the overflow plate and the surface of the magnetic-brush roll upwardly to a doctoring blade whereat the proper level of carrier is allowed to pass into the development zone. Excess carrier is accumulated at the doctoring blade and returned to the vicinity of the pickup zone by passing through a second path defined by the overflow plate means and the inner surface of the developer housing. In order to accommodate the excess carrier beads accumulated near the doctoring blade the developer housing has been expanded in that area. Additionally, magnetic fields at the doctoring blade and in the space between the doctoring blade and the edge of the overflow plate have been minimized by separating the development zone magnet from the transport magnets.

BRIEF DESCRIPTION OF THE DRAWINGS

The above-mentioned and other features and objects of this invention and the manner of attaining them will become more apparent and the invention itself will best be understood by reference to the following description of embodiments of the invention taken in conjunction with the accompanying drawings, the description of which follows.

DETAILED DESCRIPTION

Figure 1:
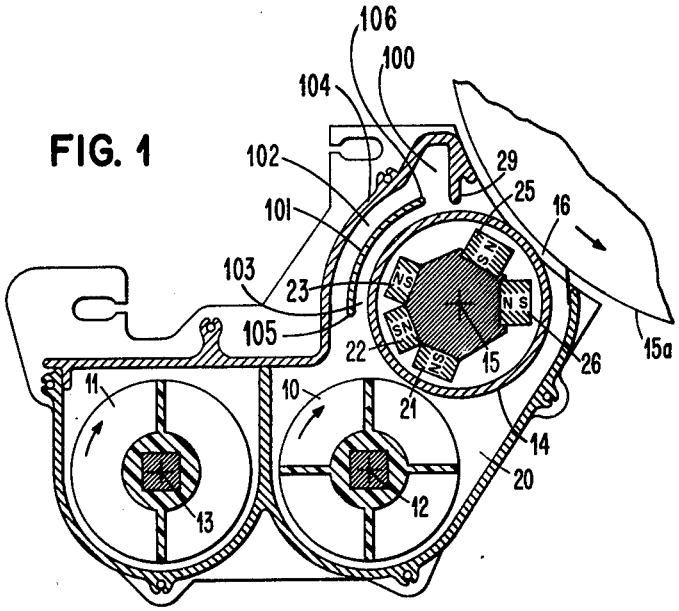
FIG. 1 is a side section view of a magnetic-brush developer embodying the present invention, taken along section line 1—1 of FIG. 2.
Figure 2:
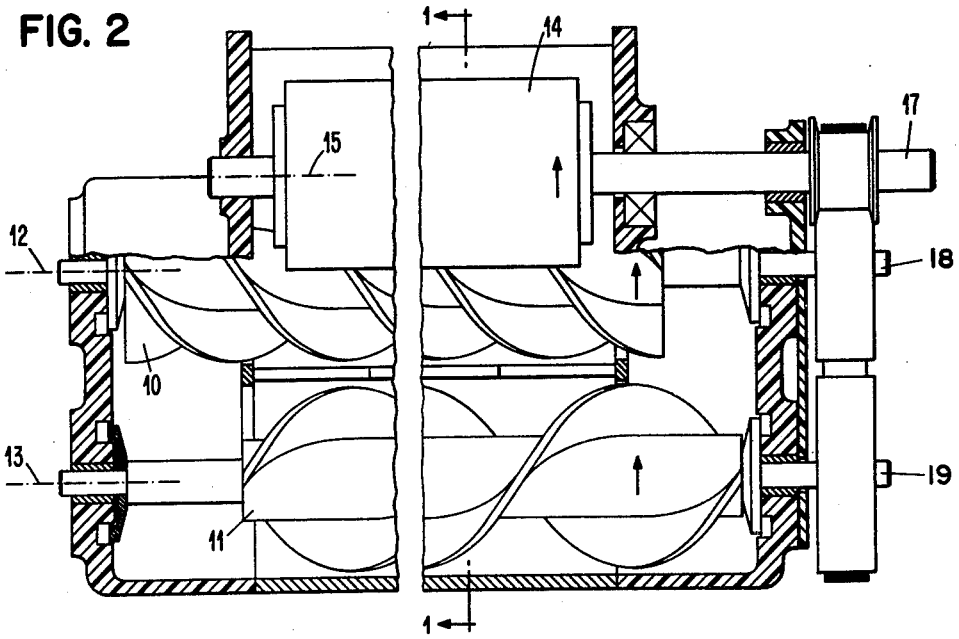
FIG. 2 is a top section view of the developer of FIG. 1 showing the center portion broken away and taken along section line 2—2 of FIG. 3.
Figure 3:
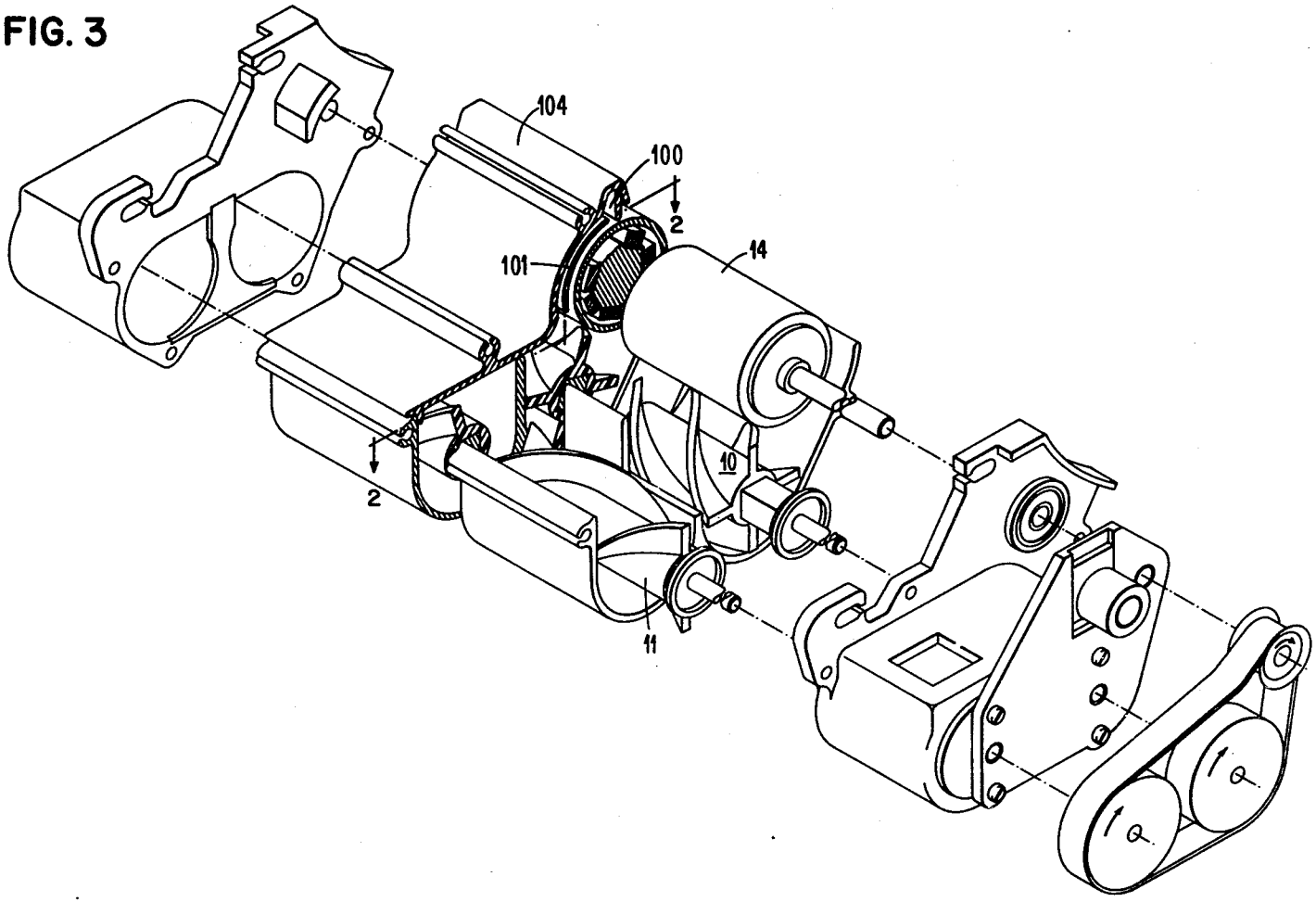
FIG. 3 is an exploded view of the developer of FIG. 1 again showing the center portion broken away.

FIGS. 1, 2 and 3 herein are identical to the similar figures in U.S. Pat. No. 3,999,514 except that the developer mechanism has been modified to show the incorporation of the instant invention.

The figures show a supply auger 10 and a return auger 11 which are designed to supply carrier beads coated with toner to the magnetic-brush roll 14. Referring to FIG. 1, these augers rotate in a clockwise direction about parallel axes 12 and 13. These two axes lie in a substantially horizontal plane. Supply auger 10 lies beneath magnetic-brush roll 14, this roll being rotatable clockwise about axis 15. Axis 15 is parallel to above-mentioned axes 12 and 13 and is parallel to the axis of photoconductor drum 15A. Drum 15A is shown rotating in a counterclockwise direction. The shafts 17, 18 and 19 are rotatably supported by bearings in the non-magnetic housing of the magnetic-brush developer and are operable by means of drive couplings, not shown, to produce clockwise rotation of the augers and the brush roll.

The developer mix comprising carrier beads and toner resides in the recirculating path defined by the return auger and the supply auger and a residual supply of this mix resides within the axially extending portion 20 of the developer housing.

A magnetic field generating cluster is mounted at a stationary position within roll 14. Pickup magnet 21 is mounted near supply auger 10 thus providing a pickup of carrier beads supplied to roll 14 by auger 10. Transport magnets 22 and 23 continue the magnetic field along the path of the periphery of roll 14 so that the magnetic carrier beads are moved from the pickup zone near magnet 21 with the moving surface of roll 14 toward the development zone. Magnet 25 is the development magnet positioned such as to carry the magnetic beads into and through the development zone while magnet 26 is a scavenger magnet designed to hold the beads to the surface of the magnetic-brush roll 14 as it rotates away from development zone 16.

As the brush roll rotates in a clockwise direction the magnetic beads are transported to the top of the brush roll through a first path 103. This path is defined by the surface of the brush roll and an overflow plate 101. Note that the bottom end 105 of overflow plate 101 acts as a lower doctoring blade to limit the height of the developer mix entering the transport zone area under the overflow plate 101. When the carrier beads reach the top of the brush roll a doctoring blade 29 removes excess carrier beads and allows only the developer mix of a predetermined height to enter the development zone. Excess carrier beads are accumulated in the expanded spatial area 100 of housing 104 and are returned to the vicinity of the pickup zone through a second path 102 which is formed by the overflow plate 101 and the inner surface of the developer housing 104. In that manner, accumulated excess carrier beads are not allowed to jam near doctor blade 29. Note that transport magnets 22 and 23 are spaced from development magnet 25. This spacing minimizes the effect of magnetic fields in the expanded spatial area 100 between doctoring blade 29 and the top end 106 of overflow plate 101. By minimizing magnetic fields in area 100, excess beads are allowed to freely move toward end 106 and through path 102. Overflow plate 101 is made of non-magnetic material such as aluminum.

While the invention has been particularly shown and described with reference to a preferred embodiment thereof, it will be understood by those skilled in the art that the foregoing and other changes in form and details may be made therein without departing from the spirit and scope of the invention.

What is claimed is:

1. A magnetic-brush developer for use in an electrophotographic machine wherein a developer material comprising a toner-coated magnetic carrier is supplied to a rotating magnetic-brush roll at a pickup zone to be transported by said roll to an elevated development zone, said developer comprising:

a housing means for enclosing said roll and holding said developer material, said housing means being open at said development zone;

said magnetic-brush roll comprising a rotating hollow roll with magnetic means disposed within said roll for creating a magnetic field in the path of the periphery of said roll;

means to bring said developer material into contact with the roll surface at said pickup zone whereat the carrier is magnetically attracted to the roll surface and moved therewith;

a doctoring blade located adjacent to the development zone opening in said housing means; and an overflow plate means mounted between said roll and the inner surface of said housing means and extending from an end adjacent to said pickup zone to an end spaced substantially apart from said doctoring blade to provide a first path between said overflow plate means and said roll through which said carrier is transported toward said doctoring blade and a second path between said overflow plate means and said inner surface of the housing means through which said carrier can fall back into said pickup zone when said carrier is accumulated in excess amounts behind said doctoring blade.

2. The developer of claim 1 in which said magnetic means provides a significant magnetic field in the path of the periphery of said roll from said pickup zone continuing under said overflow plate means, but provides an insignificant field in the path of the periphery of said roll adjacent said doctoring blade and in the space between said doctoring blade and the end of said overflow plate means.

3. The developer of claim 1 in which said housing means provides an expanded spatial area in the space between said doctoring blade and the end of said overflow plate means for accumulating excess carrier prior to that carrier falling back through said second path.

4. The developer of claim 2 in which said housing means provides an expanded spatial area in the space between said doctoring blade and the end of said overflow plate means for accumulating excess carrier prior to that carrier falling back through said second path.

5. The developer of claim 1 wherein said overflow plate means is made of a non-magnetic material.

6. The developer of claim 2 wherein said overflow plate means is made of a non-magnetic material.

7. The developer of claim 3 wherein said overflow plate means is made of a non-magnetic material.

8. The developer of claim 4 wherein said overflow plate means is made of a non-magnetic material.

* * * * *